United States Patent [19]

Segaud

[11] Patent Number: 4,946,608

[45] Date of Patent: Aug. 7, 1990

[54] LUBRICANT DISPERSIONS OF RARE EARTH HALIDES IN AN OILY MEDIUM

[75] Inventor: Christian Segaud, Chassieu, France

[73] Assignee: RHONE-POULENC CHIMIE, Courbevoie, France

[21] Appl. No.: 425,236

[22] Filed: Oct. 23, 1989

[30] Foreign Application Priority Data

Oct. 21, 1988 [FR] France ..... 88 13796

[51] Int. Cl.[5] ..... C10M 141/02

[52] U.S. Cl. ..... 252/25; 252/32.7 E; 252/33.4; 252/52 A; 252/56 R; 252/51.5 R; 252/49.8

[58] Field of Search ..... 252/25, 33.4, 32.7 E, 252/49.8, 52 A, 56 R, 51.5 R

[56] References Cited

U.S. PATENT DOCUMENTS

| | | | |
|---|---|---|---|
| 3,453,209 | 7/1969 | Sibert | 252/25 |
| 3,830,280 | 8/1974 | Larsen | 252/25 |
| 4,034,133 | 7/1977 | Fleck | 428/64 |
| 4,507,214 | 3/1985 | Aldorf | 252/25 |
| 4,735,734 | 2/1981 | Staub et al. | 252/49.5 |

*Primary Examiner*—Jacqueline V. Howard

*Attorney, Agent, or Firm*—Burns, Doane, Swecker & Mathis

[57] ABSTRACT

Novel lubricant compositions contain at least one rare earth halide, e.g., cerium trifluoride, and at least one surfactant including a hydrophobic moiety and a hydrophilic moiety, such hydrophilic moiety comprising ethylene oxide and/or propylene oxide units and, optionally, hydrophilic functional groups, dispersed in an oily medium compatible therewith.

31 Claims, No Drawings

LUBRICANT DISPERSIONS OF RARE EARTH HALIDES IN AN OILY MEDIUM

BACKGROUND OF THE INVENTION

1. Field of the Invention

The present invention relates to novel dispersions of rare earth halides in an oily medium and to a process for the formulation thereof, and, more especially, to dispersions of rare earth fluorides in oily media. This invention also relates to the use of such novel dispersions as lubricants.

2. Description of the Prior Art

When two surfaces, most typically metallic surfaces, are placed into sliding contact with each other, a lubricating film (lubricant) is usually applied between the two surfaces to reduce the friction therebetween.

Lubricants based on mineral or synthetic oils are currently most frequently used. Such lubricants generally contain various additives, for example additives to improve the index of viscosity, additives to lower the pour point, antiwear and extreme pressure additives, neutralizing additives, oxidation inhibitors, corrosion inhibitors, dispersing and detergent additives, antifoaming agents, and the like.

Among the aforenoted additives, the rare earth fluorides may be used as extreme pressure additives, preventing direct contact of metallic surfaces under severe operating conditions (seizing).

SUMMARY OF THE INVENTION

A major object of the present invention is the provision of novel dispersions of rare earth halides in an oily medium, and, in particular, such novel dispersions incorporated into a conventional lubricant formulation.

Another object of the present invention is the provision of novel dispersions of rare earth halides having adequate stability relative to the intended application thereof, typically stability over a temperature range of from −10° C. to +45° C.

Briefly, the present invention features dispersions of rare earth halides in an oily medium which comprise at least one rare earth halide, at least one oil base and at least one surface active agent containing a hydrophobic moiety and a hydrophilic moiety comprising ethylene oxide and/or propylene oxide units, and, optionally, a hydrophilic functional group.

DETAILED DESCRIPTION OF THE PREFERRED EMBODIMENTS OF THE INVENTION

More particularly according to the present invention, the subject oily dispersions of rare earth halides thus contain at least one rare earth halide.

By the term "rare earth" according to the invention are intended the rare earth elements having atomic numbers ranging from 57 to 71, inclusive, as well as yttrium which has an atomic number of 39.

The preferred rare earth elements are the ceric rare earths, such as lanthanum, cerium, praseodymium, neodymium and samarium. Among these, cerium is especially preferred.

Particularly representative of such rare earth halides are the chlorides and fluorides, with the latter being the preferred.

The aggregate sizes of the rare earth trifluorides typically range from 0.05 to 3.0 μm, with a more or less restricted grain size distribution, depending on the process for the production of the fluoride. One advantage of note of the oily dispersions of the invention is that they may be formulated from any rare earth fluoride, regardless of its grain size distribution.

An especially preferred cerium trifluoride is that described in French Application No. 88/08,909, which has a fine and restricted grain size distribution.

It has a mean diameter of its aggregates ranging from 0.1 to 0.5 μm and preferably from 0.15 to 0.30 μm, with the grain size fraction larger than 1 μm and 2 μm respectively being less than 10% and 5% by weight. The monodispersed nature of the aggregate size distribution is indicated by "dispersion index", defined by the ratio $(d_{84} - d_{16})1/2d_{50}$, which is within a range of 0.3 to 0.6 and preferably 0.3 to 0.45.

The oil comprising the rare earth halide dispersions of the invention may be a vegetable, mineral or synthetic oil.

Exemplary of the vegetable oils are rapeseed oil, flaxseed oil, soybean oil, cocoa oil and the like.

Mineral oils emanating from petroleum cracking processes are particularly suitable. These include a large number of hydrocarbons and may be classified as straight chain saturated hydrocarbons (n-paraffins) or branched chain saturated hydrocarbons (isoparaffins), alicyclic hydrocarbons or aromatic hydrocarbons.

The so-called paraffin hydrocarbons essentially consist of paraffin and isoparaffin hydrocarbons, appreciably less alicyclic hydrocarbons and very few aromatic hydrocarbons.

The naphthenic oils have higher alicyclic and aromatic hydrocarbon contents.

Paraffin and naphthenic oils, or mixtures thereof, are preferred according to the invention.

It is also possible to use a synthetic oil such as, for example, organic esters, phosphoric esters, the polyalkyleneglycols, synthetic hydrocarbons, silicone oils, and the like.

The organic esters generally correspond to the formula $R'OOC(CH_2)_nCOOR'$, in which R'is a linear or branched chain alkyl radical having approximately 6 to 9 carbon atoms and n is a number ranging from about 2 to about 20. Alkyl esters of adipic, azelaic or sebacic acids are the preferred.

The phosphoric esters generally correspond to the formula $OP(OR'')_3$ in which R''may be an alkyl or aryl radical having about 4 to 20 carbon atoms.

Tricresylphosphate is one example of such type of synthetic oil.

Exemplary of the oils of polyalkyleneglycol type are polypropyleneglycol and mixtures of polyethyleneglycol and polypropyleneglycol.

It is also possible to use a synthetic oil prepared by the polymerization of an olefin, in particular isobutylene.

And exemplary of the silicone oils are the dimethylpolysiloxanes, the diphenylpolysiloxanes and the methylphenylpolysiloxanes.

The surface active agent comprising the dispersions of rare earth halides of the invention includes a hydrophobic moiety, preferably of the same chemical nature as the oil base, to permit its solubilization in such oil.

The hydrophobic moiety may be a hydrocarbon group, such as, for example, a saturated or unsaturated, linear or branched chain alkyl or cycloalkyl group, a phenyl or alkylphenyl group, or a naphthyl or alkylnaphthyl group.

The hydrophilic moiety of the surface active agent is capable of being adsorbed onto the surface of a solid, i.e., the rare earth halide. It may contain oxyethylene and/or oxypropylene units and optionally anionic groups, such a sulfonate, a sulfate or a phosphate.

The number of ethylene oxide and/or propylene oxide units is advantageously equal to or less than 12. It preferably ranges from 2 to 8.

Exemplary of the surface active agents suitable for use in the dispersions of rare earth halides of the invention, the following are particularly representative:

(i) aliphatic polyoxyalkylene fatty acids, optionally comprising sulfate or phosphate groups;

(ii) polyoxyalkylene alkylphenols, optionally comprising sulfate or phosphate groups;

(iii) polyoxyalkylene poly(1-phenylalkyl)phenols, optionally comprising sulfate or phosphate groups;

(iv) fatty acid amides or amines, polyoxyalkylene oils or fats.

Particularly suitable for use according to the invention are the polyoxyalkylene fatty alcohols, mixed sulfates of polyoxyethylene fatty alcohols or phosphoric esters of polyoxyethylene fatty alcohols having the following formulae (I) to (III):

$$R_1\text{-}(O\text{-}R)_n\text{-}OH \quad \text{(I)}$$

$$R_1\text{-}(O\text{-}R)_n\text{-}O\,SO_3\,X \quad \text{(II)}$$

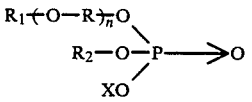

(III)

wherein n is a number ranging from about 1 to about 12; X is a hydrogen atom or an inorganic or organic base radical; R is an alkylene radical having 2 and/or 3 carbon atoms; $R_2$ is a radical X, with the proviso that the two X radicals may be identical or different (if $R_2=X$), or one of the radicals $$R\text{-}(O\text{-}R)_n,$$

with the proviso that $R_2$ and $$R_1\text{-}(O\text{-}R)_n$$

may also be identical or different; and $R_1$ is a saturated or unsaturated, linear or branched chain aliphatic radical containing from about 4 to about 30 carbon atoms.

In the above description, by the term "inorganic or organic base radical" are intended metal atoms, most typically an alkali metal such as sodium or potassium, an ammonium radical or a substituted ammonium radical of the formula $N(R_kR_1R_mR_n)$, in which $R_k$ is hydrogen and $R_1$, $R_m$, $R_n$, which may be identical or different, are each a hydrogen atom, or a linear or branched chain alkyl or hydroxyalkyl radical having from 1 to about 4 carbon atoms, or a phenyl radical, with the proviso that two of such alkyl radicals may together form a single divalent radical optionally containing a bridging oxygen atom.

The preferred surface active agents correspond to one of formulae (I) to (III), in which:

(i) n ranges from 2 to 10;

(ii) X is a hydrogen atom, a sodium or potassium atom, an ammonium radical, or a monoethanolamine, diethanolamine or triethanolamine radical;

(iii) R is an ethylene and/or propylene radical;

(iv) $R_1$ is a saturated or unsaturated, linear or branched chain aliphatic radical having from 6 to 20 carbon atoms; and (v) $R_2$ is either a radical X (with the two radicals being identical if $R_2=X$), or a radical $$R_1\text{-}(O\text{-}R)_n,$$

with the radicals $R_2$ and $$R_1\text{-}(O\text{-}R)_n$$

being identical.

Exemplary fatty alcohols comprising the formulae (I) to (III) are particularly the primary alcohols resulting from an OXO synthesis and notably mixtures of isomeric alcohols marketed under the designation of "amyl", "isohexanol", "isodecanol", "tridecanol", "hexadecanol" and primary alcohols or linear aliphatic alcohols obtained by the Ziegler process and available in the form of fractions which are mixtures of $C_6$ to $C_{10}$ and $C_{12}$ to $C_{20}$ alcohols. Representative polyoxyalkylene fatty acids suitable for the invention are particularly those derived from lauric, stearic and oleic alcohols, and tridecanol from an OXO synthesis.

Polyoxyalkyl alkylphenols, mixed sulfates of polyoxyalkyl alkylphenols or phosphoric esters of polyoxyalkyl alkylphenols having the following formulae (IV) to (VI) are also suitable:

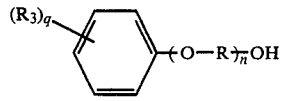

(IV)

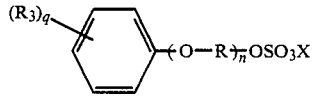

(V)

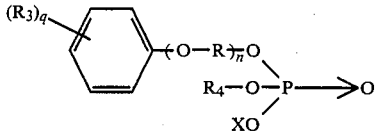

(VI)

wherein n is a number ranging from about 1 to about 12; g is a number ranging from 1 to 3; X is a hydrogen atom or an inorganic or organic base radical; R is an alkylene radical having 2 and/or 3 carbon atoms; $R_4$ is either a radical X, with the proviso that the two X radicals (if $R_4=X$) may be identical or different, or one of the radicals:

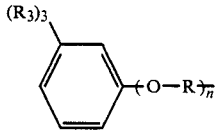

with the proviso that $R_4$ and

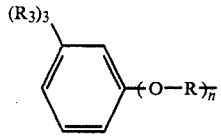

may be identical or different; and the radicals $R_3$, which may be identical or different, are each a saturated or unsaturated, linear or branched chain aliphatic radical having from about 6 to 20 carbon atoms.

The preferred surface active agents correspond to one of the formulae (IV) to (VI), in which:

(i) n ranges from 1 to 8;

(ii) q is equal to 1;

(iii) X is a hydrogen atom, a sodium or potassium atom, an ammonium radical, or a monoethanolamine, diethanolamine or triethanolamine radical;

(iv) R is an ethylene and/or propylene radical;

(v) $R_3$ is a saturated, linear or branched chain aliphatic radical having 6 to 12 carbon atoms;

(vi) $R_4$ is either a radical X (with the two radicals being identical or different if $R_4=X$, or one of the radicals:

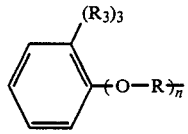

with the proviso that $R_4$ and

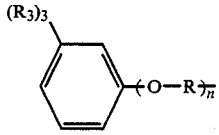

may be identical or different.

The polyoxyethylene derivatives of octylphenol, monylphenol, dodecylphenol and dinonylphenol are the preferred.

Exemplary surface active agents are also the polyoxyalkylene poly(1-phenylalkyl)phenols, mixed sulfates of polyoxyalkylene poly(1-phenylalkyl)phenols or phosphoric esters of polyoxyalkylene poly(1-phenylalkyl)phenols having the following formulae (VII) to (IX):

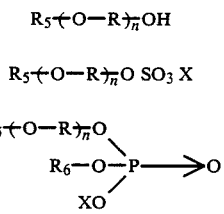

(VII)

(VIII)

(IX)

wherein n is a number ranging from 1 to about 12; X is a hydrogen atom or an inorganic or organic base radical as defined above; R is an alkylene radical having 2 and/or 3 carbon atoms; $R_6$ is a radical X, with the proviso that the two radicals X may be identical or different (if $R_6=X$), or one of the radicals

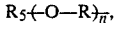

with the proviso that $R_6$ and

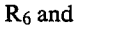

may be identical or different; and $R_5$ is one of the radicals of formula (X):

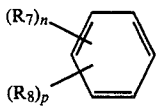

(X)

in which m is an integer equal to 1, 2 or 3; p is an integer equal to 1 or 2; $R_8$ is a hydrogen atom or an alkyl radical having 1 to 4 carbon atoms; and $R_7$ is a radical of formula (XI):

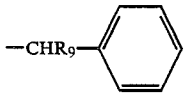

(XI)

in which $R_9$ is a hydrogen atom, an alkyl radical having 1 to 4 carbon atoms or a phenyl radical.

The preferred surface active agents correspond to one of the formulae (VII) to (IX), in which:

(i) R is an ethylene and/or propylene radical;

(ii) $R_5$ is a radical of formula (X) in which m is equal to 2 or 3; $R_8$ is a hydrogen atom, the radical $R_7$ is a radical of formula (XI):

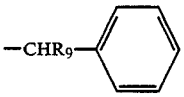

(XI)

in which $R_9$ is a hydrogen atom, or a methyl or phenyl radical;

(iii) $R_6$ is either a radical X, with the proviso that the two radicals X may be identical or different (if $R_6=X$), or one of the radicals

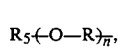

with the proviso that $R_6$ and

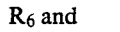

may be identical or different.

Among this preferred group of surface active agents, those of formulae (VII) to (IX) are particularly suitable, in which:

(i) n ranges from 2 to 10;

(ii) X is a hydrogen atom, a sodium or potassium atom, an ammonium radical, or a monoethanolamine, diethanolamine or triethanolamine radical;

(iii) R is an ethylene and/or propylene radical;

(iv) $R_5$ is a radical of formula (X), in which m is equal to 2, $R_8$ is a hydrogen atom, and $R_7$ a radical of formula (XI):

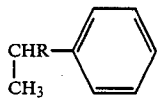

(XI)

(v) $R_6$ is either a radical X, with the proviso that the two radicals X may be identical or different (if $R_6$=X), or one of the radicals $$R_5\text{-}(O\text{—}R)_n,$$

with the proviso that $R_6$ and $$R_5\text{-}(O\text{—}R)_n$$

may be identical or different.

The preferred surface active agents are the following:

(A) the polyoxyethylene di(1-phenylethyl)phenols having 3 to 12 moles of ethylene oxide (E.O.) per mole of phenol;

(B) the polyoxyethylene di(1-phenylethyl)phenol sulfates having 3 to 12 moles of ethylene oxide per mole of phenol, in the acid form or neutralized;

(C) the phosphoric mono- or diesters of polyoxyethylene di(1-phenylethyl)phenols having 3 to 12 moles of ethylene oxide per mole of phenol, in the acid form or neutralized.

The various surface active agents noted above are known materials and are commercially available. In particular, the following products marketed by the assignee hereof are exemplary:

(i) the polyoxyethylene di(1-phenylethyl)phenol sulfates marketed under the trademarks SOPROPHOR DSS 5 (5 E.O.), DSS 7 (7 E.O.), DSS 11 (11 E.O.) (acid form or neutralized);

(ii) the phosphoric mono- and diesters of polyoxyethylene di(1-phenylethyl)phenols marketed under the trademarks SOPROPHOR 10 D 12/5 (5 E.O.), 10 D 12/7 (7 E.O.), 10 D 12/11 (11 E.O.) (neutralized or acid form).

The compounds of formulae (VII) to (IX) may be used separately or in admixture. The phosphoric esters of formula (IX) may be used separately, or more generally in the form of mixtures of the monoester with the corresponding diester.

Also exemplary of the surface active agents are the amides of polyoxyalkyl fatty acids, for example of lauric acid or coconut oil.

Preferred surface active agents also include the amines of polyoxyalkylene fatty acids and in particular the saturated or unsaturated monocarboxylic or dicarboxylic fatty acids having from about 8 to about 10 carbon atoms, polycondensed with about 2 to 10 moles of alkylene oxide.

Exemplary of the fatty acids are lauric acid, myristic acid, palmitic acid, stearic acid, oleic acid and natural fatty acids in admixture with soybean, coconut or copra oil, or with fats, in particular tallow.

More particularly, the preferred dispersions of cerium trifluoride in an oily medium of the invention contain a mineral oil of the paraffin type and a surface active polyoxyethylene derivative of a saturated, linear or branched chain fatty alcohol or alcohols or an amine of a synthetic or natural fatty acid or acids, with the number of moles of ethylene oxide per mole of alcohol or amine preferably being less than 10 and even more preferably ranging from 2 to 6.

The proportions by weight of the different components of the dispersions according to the invention are generally within the following ranges:

(i) 5% to 80% of a rare earth halide or halides;

(ii) 0.1% to 12% of at least one of said surface active agents;

(iii) oil, in an amount sufficient to constitute 100% of the dispersion.

The preferred dispersions have the following compositions:

(i) 20% to 60% of one or more rare earth halides;

(ii) 2% to 8% of at least one of said surface active agents;

(iii) oil, in an amount sufficient to constitute 100% of the dispersion.

One technique for formulating dispersions of rare earth halides in an oily medium entails preparing a solution of the surface active agent described above in an oil base, which constitutes the dispersion medium, next dispersing under agitation at least one rare earth halide, then grinding the dispersion and optionally degassing the dispersion obtained.

The preparation of the dispersion medium is not difficult. It is carried out under agitation by conventional means of agitation (anchor, helical or turbine agitators).

The rare earth halide is dispersed under agitation.

Grinding is continued until an average particle size of approximately 4 μm is produced. It is preferable that no particle be larger than 50 μm.

The dispersion may be ground in a vertical or horizontal ball grinder.

Degassing is carried out by maintaining the dispersion under weak agitation.

It is possible to add, during grinding or degassing, optional additives required for the intended application, for example viscosity index modifiers (thickeners or fluidizers), oxidation and corrosion inhibitors.

According to the invention, rare earth halide dispersions in an oily medium are produced, having the following properties:

(1) a very high stability in storage;

(2) a high content in rare earth halides; and (3) a low viscosity.

The dispersions of rare earth halides in an oily medium may be used in all application for which such dispersions are employed, in particular in the fields of lubrication and corrosion.

In particular, the dispersions of rare earth fluorides in an oily medium may be incorporated in the oil phase of conventional lubricant formulations in the liquid, grease or paste form.

In order to further illustrate the present invention and the advantages thereof, the following specific examples are given, it being understood that same are intended only as illustrative and in nowise limitative.

EXAMPLES 1 TO 9

In Examples 1 to 9, cerium trifluoride was dispersed in an oily medium. The cerium trifluoride had a mean aggregate diameter of 0.3 μm.

In all of the examples, the procedure described below was carried out.

Initially, the dispersion medium was prepared by dissolving 101 g of the surface active agent set forth in the different examples in 1000 g PRIMOL 352, which was a paraffinic mineral oil containing 70% paraffin hydrocarbons and 30% naphthenic hydrocarbons (% in carbon).

664 g of cerium trifluoride were added under agitation by means of an ULTRA-TURAX turbine rotating at 1,500 rpm.

The agitation was maintained for 3 minutes to produce a homogeneous mixture.

In this manner a predispersion was obtained, which was then ground in a "Mini Motor Mill" marketed by Eiger Engineering Ltd. The grinding chamber was filled with 59 g glass beads 1 mm in diameter and rotated at 4,000 rpm. Grinding was continued for about 4 minutes.

The stability properties of the dispersion were determined by subjecting it to an accelerated aging test, i.e., heating the dispersion in an oven at 40° C. for 1 week.

The stability of the dispersion obtained after storage was determined by measuring the percentage of the oily supernatant on the dispersion, said phenomenon being designated the "syneresis".

In Examples 1 to 9, the operating procedure described above was followed, using the following surface active agents:

EXAMPLE 1 amine of polyoxyethylene oleic acid containing 2 moles of ethylene oxide per mole of amine (SOPROMINE 0 12);

EXAMPLE 2 fractions of primary linear $C_{12}$–$C_{14}$ polyoxyethylene alcohols with 4 moles of ethylene oxide per mole of alcohol (SOPROPHOR LA 40);

EXAMPLE 3 phosphoric acid ester of the polyoxyethylene OXO "tridecanol" alcohol with 3.2 moles of ethylene oxide per mole of alcohol (SOPROPHOR MB);

EXAMPLE 4 phosphoric acid ester of polyoxyethylene nonylphenol with 6 moles of ethylene oxide per mole of alcohol (SOPROPHOR PA 15);

EXAMPLE 5 polyoxyethylene OXO "tridecanol" alcohol with 3.2 moles of ethylene oxide per mole of alcohol (SOPROPHOR 840);

EXAMPLE 6 polyoxyethylene nonylphenol with 4 moles of ethylene oxide per mole of phenol (SOPROPHOR BC 4);

EXAMPLE 7: polyoxyethylene and polyoxypropylene OXO "tridecanol" alcohol containing 1.5 moles of propylene oxide and 2.5 moles of ethylene oxide per mole of alcohol (SOPROPHOR OX 135);

EXAMPLE 8 polyoxyethylene OXO "tridecanol" alcohol containing 6 moles of ethylene oxide per mole of alcohol (SOPROPHOR 860 P);

EXAMPLE 9 polyoxyethylene nonylphenol with 2 moles of ethylene oxide per mole of phenol (SOPROPHOR BC 2).

The results obtained are reported in the Table which follows:

TABLE

| Example | Surface active agent | Height of supernatant in % after storage of the dispersion for 1 week at 40° C. |
|---|---|---|
| 1 | Oleic acid amine with 2 ethylene oxide units (SOPROMINE O 12) | 1 |
| 2 | $C_{14}$–$C_{16}$ alcohol with 4 ethylene oxide units (SOPROPHOR LA 40) | 2 |
| 3 | Phosphoric acid ester of $C_{13}$ OXO alcohol with 3.2 ethylene oxide units (SOPROPHOR MB) | 2 |
| 4 | Nonylphenol ester of phosphoric acid with 6 ethylene oxide units (SOPROPHOR PA 15) | 5 |
| 5 | $C_{13}$ OXO with 3.2 ethylene oxide units (SOPROPHOR 840) | 8 |
| 6 | Nonylphenol with 4 ethylene oxide units (SOPROPHOR BC 4) | 8 |
| 7 | $C_{13}$ OXO alcohol with 1.5 and 2.5 ethylene oxide units (SOPROPHOR OX 135) | 8 |
| 8 | $C_{13}$ OXO alcohol with 6 ethylene oxide units (SOPROPHOR 860 P) | 9 |
| 9 | Nonylphenol with 2 ethylene oxide units (SOPROPHOR BC 2) | 10 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A lubricant composition of matter which comprises at least one rare earth halide and at least one surface active agent dispersed in an oil medium compatible therewith, said at least one surface active agent containing a hydrophobic moiety and a hydrophilic moiety comprising ethylene oxide and/or propylene oxide structural units.

2. The lubricant composition as defined by claim 1, said at least one surface active agent further comprising hydrophilic functional groups.

3. The lubricant composition as defined by claim 1, said at least one rare earth halide comprising a rare earth trifluoride.

4. The lubricant composition as defined by claim 3, said at least one rare earth comprising cerium, lanthanum, praseodymium, neodymium and/or samarium.

5. The lubricant composition as defined by claim 4, comprising a cerium trifluoride having a mean aggregate diameter ranging from 0.1 to 0.5 $\mu$m.

6. The lubricant composition as defined by claim 1, said oil medium comprising a vegetable, mineral or synthetic oil.

7. The lubricant composition as defined by claim 6, said oil medium comprising a mineral oil of petroleum cracking origin.

8. The lubricant composition as defined by claim 6, said oil medium comprising a paraffin oil, naphthenic oil, or mixture thereof.

9. The lubricant composition as defined by claim 6, said oil medium comprising a synthetic oil.

10. The lubricant composition as defined by claim 9, said synthetic oil comprising an organic ester, phosphoric ester, polyalkylene glycol, hydrocarbon or silicone oil.

11. The lubricant composition as defined by claim 1, said at least one surface active agent comprising a hydrophobic moiety of the same chemical nature as said oil medium.

12. The lubricant composition as defined by claim 1, the hydrophobic moiety of said at least one surface active agent comprising a saturated or unsaturated, linear or branched chain alkyl or cycloalkyl group, a phenyl or alkylphenol group, or a naphthyl or alkylnaphthyl group.

13. The lubricant composition as defined by claim 2, said at least one surface active agent comprising a hydrophilic sulfonate, sulfate or phosphate group.

14. The lubricant composition as defined by claim 1, said at least one surface active agent comprising up to 12 ethylene oxide and/or propylene oxide units per mole thereof.

15. The lubricant composition as defined by claim 14, said at least one surface active agent comprising from 2 to 6 such oxide units.

16. The lubricant composition as defined by claim 1, said at least one surface active agent comprising an aliphatic polyoxyalkylene fatty acid, or sulfate or phosphate thereof; a polyoxyalkylene alkylphenol, or sulfate or phosphate thereof; a polyoxyalkylene poly(1-phenylalkyl)phenol, or sulfate or phosphate thereof; a fatty acid amide or amine; or a polyoxyalkylene oil or fat.

17. The lubricant composition as defined by claim 1, said at least one surface active agent having one of the following formulae (I) to (III):

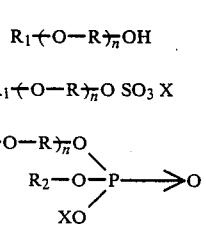

(I)

(II)

(III)

wherein n is a number ranging from 1 to about 12; X is a hydrogen atom or an inorganic or organic base radical; R is an alkylene radical having 2 and/or 3 carbon atoms; $R_2$ is a radical X, with the proviso that the two radicals X may be identical or different if $R_2=X$, or one of the radicals $R_1$-(O-R)$_n$, with the proviso that $R_2$ and $R_1$-(O-R)$_n$ may be identical or different; and $R_l$ is a saturated or unsaturated, linear or branched chain aliphatic radical containing from about 4 to about 30 carbon atoms.

18. The lubricant composition as defined by claim 17, wherein formulae (I) to (III), n ranges from 2 to 10; X is a hydrogen atom, a sodium or potassium atom, an ammonium radical, or a monoethanolamine, diethanolamine or triethanolamine radical; R is an ethylene and/or propylene radical; $R_l$ is a saturated or unsaturated, linear or branched chain aliphatic radical having from 6 to 20 carbon atoms; and $R_2$ is either a radical X, with the proviso that the two radicals are identical if $R_2=X$, or a radical $R_1$-(O-R)$_n$, with the proviso that the radicals $R_2$ and $R_1$-(O)$_n$ are identical.

19. The lubricant composition as defined by claim 17, said at least one surface active agent comprising an OXO or Ziegler process primary alcohol.

20. The lubricant composition as defined by claim 1, said at least one surface active agent having one of the following formulae (IV) to (VI):

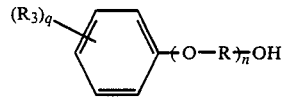

(IV)

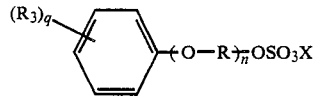

(V)

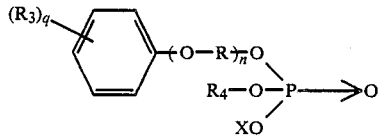

(VI)

wherein n is a number ranging from 1 to about 12; g is a number ranging from 1 to 3; X is a hydrogen atom or an inorganic or organic base radical; R is an alkylene radical having 2 and/or 3 carbon atoms; $R_4$ is either a radical X, with the proviso that the two radicals X, if $R_4=X$, may be identical or different, or one of the radicals:

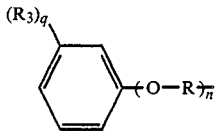

with the proviso that $R_4$ and

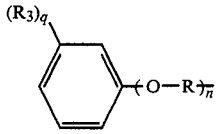

may be identical or different; and the radicals $R_3$, which may be identical or different, are each a saturated or unsaturated, linear or branched chain aliphatic radical having from about 6 to 20 carbon atoms.

21. The lubricant composition as defined by claim 20, wherein formulae (IV) to (VI), n ranges from 1 to 8; q is equal to 1; X is a hydrogen atom, a sodium or potassium atom, an ammonium radical, or a monoethanolamine, diethanolamine or triethanolamine radical; R is an ethylene and/or propylene radical; $R_3$ is a saturated, linear or branched chain aliphatic radical having 6 to 12 carbon atoms; and $R_4$ is a radical X, with the proviso that the two X radicals may be identical or different, if $R_4=X$, or one of the radicals:

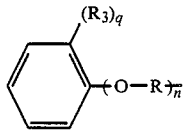

with the proviso that $R_4$ and

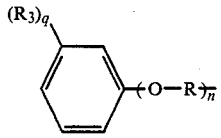

may be identical or different.

22. The lubricant composition as defined by claim 20, said at least one surface active agent comprising a derivative of octylphenol, nonylphenyl or dinonylphenol.

23. The lubricant composition as defined by claim 1, said at least one surface active agent having one of the following formulae (VII) to (IX):

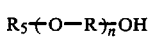

(VII)

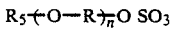

(VIII)

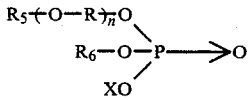

(IX)

wherein n is a number ranging from 1 to about 12; X is a hydrogen atom or an inorganic or organic base radical; R is an alkylene radical having 2 and/or 3 carbon atoms; $R_6$ is a radical X, with the proviso that the two radicals X may be identical or different if $R_6=X$, or one of the radicals $R_5$-(O-R)$_n$-, with the proviso that $R_6$ and $R_5$ -(O-R$_n$- may be identical or different; and $R_5$ is a radical of the formula (X):

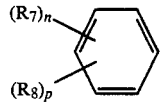

(X)

in which m is an integer equal to 1, 2, 3; p is an integer equal to 1 or 2; $R_8$ is a hydrogen atom or an alkyl radical having 1 to 4 carbon atoms; and $R_7$ is a radical of the formula (XI):

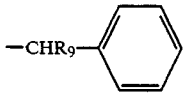

(XI)

in which $R_9$ is a hydrogen atom, an alkyl radical having 1 to 4 carbon atoms or a phenyl radical.

24. The lubricant composition as defined by claim 23, wherein formulae (VII) to (IX), R is an ethylene and/or propylene radical; $R_5$ is a radical of formula (X) in which m is equal to 2 or 3, $R_8$ is a hydrogen atom, and $R_7$ a radical of the formula (XI):

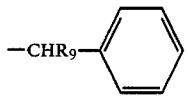

(XI)

in which $R_9$ is a hydrogen atom or a methyl or phenyl radical; and $R_6$ is a radical X, with the proviso that the two radicals X may be identical or different if $R_6=X$, or one of the radicals R-(O-R)$_n$-, with the proviso that $R_6$ and $R_5$-(O-R$_n$ are identical.

25. The lubricant composition as defined by claim 23, wherein formulae (VII) to (IX), n ranges from 2 to 10; X is a hydrogen atom, a sodium or potassium atom, an ammonium radical, or a monoethanolamine, diethanolamine or triethanolamine radical; R is an ethylene and/or propylene radical; $R_5$ is a radical of formula (X) in which m is equal to 2, $R_8$ is a hydrogen atom, and $R_7$ is a radical of formula (XI):

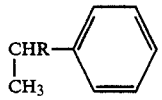

(XI)

and $R_6$ is a radical X, with the proviso that the two radicals X may be identical or different if R6 =X, or one of the radicals $R_5$-(O-R)$_n$-, with the proviso that $R_6$ and $R_5$-(O-R$_n$ are identical.

26. The lubricant composition as defined by claim 23, said at least one surface active agent comprising a polyoxyethylene di(1-phenylethyl)phenol having 3 to 12 moles of ethylene oxide per mole of phenol; a polyoxyethylene di(1-phenylethyl)phenol sulfate having 3 to 12 moles of ethylene oxide per mole of phenol, either in acid form or neutralized; or a phosphoric mono- or diester of a polyoxyethylene di(1-phenylethyl)phenol having 3 to 12 moles of ethylene oxide per mole of phenol, either in acid form or neutralized.

27. The lubricant composition as defined by claim 1, said at least one surface active agent comprising an amine of a saturated or unsaturated monocarboxylic or dicarboxylic fatty acid having from about 8 to about 24 carbon atoms, polycondensed with from about 2 to 10 moles of an alkylene oxide.

28. The lubricant composition as defined by claim 27, said at least one surface active agent comprising a polyoxyalkylene derivative of lauric acid, myristic acid, palmitic acid, stearic acid, oleic acid, or a natural fatty acid in admixture with soybean, coconut or copra oil, or with a fat of tallow.

29. The lubricant composition as defined by claim 1, comprising cerium trifluoride, a paraffinic mineral oil, and at least one surface active agent which comprises a polyoxyethylene derivative of a saturated, linear or branched chain fatty alcohol or alcohols or an amine of a synthetic or natural fatty acid or acids, with the number of moles of ethylene oxide per mole of alcohol or amine being less than 10.

30. The lubricant composition as defined by claim 1, comprising 5% to 80% of at least one rare earth halide; 0.1% to 12% of at least one surface active agent; and oil, in an amount sufficient to constitute 100% of the dispersion.

31. The lubricant composition as defined by claim 30, comprising 20% to 60% of at least one rare earth halide; 2% to 8% of at least one surface active agent; and oil, in an amount sufficient to constitute 100% of the dispersion.

* * * * *